US006945170B2

(12) United States Patent
Schultze et al.

(10) Patent No.: US 6,945,170 B2
(45) Date of Patent: Sep. 20, 2005

(54) REGISTER CONTROL METHOD

(75) Inventors: Stephan Schultze, Lohr am Main (DE); Hans-Juergen Doeres, Lohr am Main (DE)

(73) Assignee: Rexroth Indramat GmbH, Lohr am Main (DE)

( * ) Notice: Subject to any disclaimer, the term of this patent is extended or adjusted under 35 U.S.C. 154(b) by 0 days.

(21) Appl. No.: 10/473,496

(22) PCT Filed: Apr. 8, 2002

(86) PCT No.: PCT/DE02/01272

§ 371 (c)(1),
(2), (4) Date: Feb. 23, 2004

(87) PCT Pub. No.: WO02/081220

PCT Pub. Date: Oct. 17, 2002

(65) Prior Publication Data

US 2004/0134364 A1 Jul. 15, 2004

(30) Foreign Application Priority Data

Apr. 6, 2001 (DE) ..... 101 17 454

(51) Int. Cl.[7] ..... B41F 13/24
(52) U.S. Cl. ..... 101/248; 101/483; 101/484
(58) Field of Search ..... 101/484, 483, 101/218, 485, 248

(56) References Cited

U.S. PATENT DOCUMENTS 3,717,092 A * 2/1973 Crum ..... 101/248
4,318,176 A * 3/1982 Stratton et al. ..... 700/125
4,428,287 A * 1/1984 Greiner ..... 101/170
4,484,522 A * 11/1984 Simeth ..... 101/248
4,596,468 A * 6/1986 Simeth ..... 356/400
5,309,834 A 5/1994 Koch
5,448,266 A * 9/1995 Jamzadeh ..... 347/225
5,894,802 A 4/1999 Jackson
6,095,043 A 8/2000 Hartmann et al.
6,621,585 B1 * 9/2003 Patel et al. ..... 358/1.12
2004/0163562 A1 * 8/2004 Lewis et al. ..... 101/465
2004/0231536 A1 * 11/2004 Gerner et al. ..... 101/217
2005/0034615 A1 * 2/2005 Holm et al. ..... 101/218

FOREIGN PATENT DOCUMENTS

GB 2170447 A * 8/1986 ..... B41F/33/02

OTHER PUBLICATIONS

"Synax Dezentrales System Zur Synchronisierung . . . " Syntax 6, Rexroth Indramat, 2000.
Deitscher Drucker Nr. 18/8.5. 1997, pp. W30, W32, W34.
Regelungstechnik Und Prozess–Datenverarbeitung, 21. JG 1973, HEFT 3, pp. 69–76.

* cited by examiner

*Primary Examiner*—Charles H. Nolan, Jr.
(74) *Attorney, Agent, or Firm*—Michael J. Striker

(57) ABSTRACT

A method for register correction in machines for processing webs of material includes providing at least one transport shaft and at least one processing shaft cooperating with the at least one transport shaft, driving the shafts synchronously with one another each by an individual drive mechanism, obeying by at least one shaft a chronological guide shaft function which corresponds to an instantaneous position of a guide shaft, correcting a plurality of register-tracking shafts formed by the transport shafts in accordance with a scan of register marks or the web of material relative to the guide shaft function, effecting only one common scanning for one group of the register-tracking shafts which correspond to one another in term of the register correction, and deriving from the only one common scanning a common correction function that all of the register-tracking shafts of the group obey.

12 Claims, 3 Drawing Sheets

REGISTER CONTROL METHOD

BACKGROUND OF THE INVENTION

The invention relates to a method for register correction in machines that process webs of material.

Such a machine has transporting and processing stations, for instance with appropriate driven cylinders. In this respect, for the sake of simplicity, merely their shafts will be referred to.

Such methods are employed for instance in rotary printing presses, paper processing machines or sheet-fed printing presses, when an already-processed or -printed web of paper is to be further processed or printed (insetting), so that the subsequent processing steps must be done at a longitudinal position that is oriented precisely relative to an imprint that has already been made on the paper web. This assures that for instance two successively applied printed motifs will coincide in the predetermined relative position on the paper. To achieve this, cooperating transport shafts and processing shafts are corrected relative to one another by means of the register correction.

In machines that process webs of material, the principle has meanwhile become established that the shafts of a processing machine or part of a machine be equipped with individual drive mechanisms synchronized with one another, thus for instance replacing a mechanical vertical shaft (see for instance the documentation of SYNAX 6, 2000, put out by Rexroth Indramat GmbH). To that end, the applicable shafts (as a result of the synchronization of the associated drive mechanisms, or via higher-order controls) obey a higher-order chronological guide shaft function and are thereby synchronized. In such a context, "obey" means that the motion of the applicable shaft is derived directly from the guide shaft function, or from the guide shaft function via an (electronic) conversion. The guide shaft function corresponds to an instantaneous position of a guide shaft that is for instance virtual, that is, electronically generated, or a real guide shaft. For instance, it can reflect the course over time of the instantaneous position, that is, the angular position of the guide shaft; however, it can also include the course over time of the speed of rotation or other parameters corresponding to the instantaneous position of the guide shaft. In particular, it is an electronic, chronological sequence of set-point values.

In addition, a plurality of register-tracking shafts are corrected relative to the guide shaft function in accordance with a scan of register marks of the webs of material. These shafts are corrected in terms of their instantaneous position, their instantaneous speed of rotation, or corresponding parameters. The extent of the correction is determined by the scanning of register marks. The register marks can for instance be printed on—as is usual in the prior art—and can be scanned optically.

It is known for each shaft to be corrected to be regulated with its own register regulator. The necessity therefore arises of parametrizing each shaft and its regulator individually and to optimize them in terms of the corrective motions and the synchronicity with the other shafts. The effort upon startup is accordingly great; furnishing such a high number of individual register regulators is additionally associated with high effort for apparatus and leads to high costs. Nevertheless, the synchronicity of the shafts to be corrected is not always satisfactory, since intrinsically, mechanically and electronically caused deviations can occur between the individual register regulators. The result can be fluctuations in the tension of the web.

It is also known to have one register regulator act simultaneously on a plurality of shafts. To that end, an individual correction signal is transmitted to each shaft—that is, to the applicable drive mechanism or applicable controller of the applicable element, such as the cylinder—where it is converted into the corresponding individual corrective motion. The effort and expense for this rises sharply with the number of shafts to be regulated, so that for a large number of shafts to be regulated—which is widely the case—this method can be employed only with limitations, if at all. Problems of synchronicity can also occur because of excessively long cycle times in transmitting the correction signal.

SUMMARY OF THE INVENTION

The object of the present invention is to disclose a method of the type defined at the outset which—particularly when there is a large number of shafts to be regulated—assures a greater degree of synchronicity of the shafts to be corrected and at the same time permits simple startup at comparatively little effort and expense for apparatus.

The invention offers the advantage that with only a single register regulator, an arbitrary number of shafts can be regulated synchronously. This reduces the effort and expense for apparatus and makes startup substantially easier. A method according to the invention for register correction, while achieving these advantages, automatically leads to a maximum degree of synchronicity of the corrective motions.

These advantages are attained in that from a common scanning operation, a correction function that is common to a plurality of shafts to be corrected, and that in particular is chronological, is attained. This correction function is obeyed by all the shafts of one group of register-tracking shafts that correspond to one another in terms of the register correction. Accordingly, all the information for all the corrective motions is contained in the uniform correction function pertaining to all the shafts of the group. A group of register-tracking shafts that correspond to one another includes only shafts that are to be regulated with a common register regulator, for which accordingly the same register correction and the same scanning are definitive. These are shafts at a cohesive/uninterrupted web of material. In rotary printing presses, this can be some or all the shafts of one processing tower, such as a printing tower, or shafts of different processing towers, between which the web of material is not cut/not interrupted.

By the use of a uniform correction function that is calculated on the basis of only one register regulator and is uniform for all the shafts of the group, many register regulators can be eliminated, compared to the prior art. Nevertheless, a high degree of synchronicity is attained, so that the invention is doubly useful.

Even if only one register regulator for one group of shafts—which can also include many shafts—is used, a high degree of synchronicity is automatically assured, since for all the shafts of the group, it is possible to use only a single correction function—and thus only a single correction signal. Thus only a single signal has to be transmitted to the shafts of the group, as well. The correction function once ascertained can be used practically simultaneously and uniformly for all the shafts and thus automatically offers a high degree of synchronicity of the adjusting motions on the basis of the correction, without any further provisions of any kind for the purpose having to be made.

By means of the invention, it furthermore becomes possible for the first time to adjust a large number of shafts on the basis of only one register regulator while preserving a maximum degree of synchronicity. The adjusting motions can be ascertained for many shafts with only one register regulator and can then be used for all of these shafts and can be transmitted to these shafts practically simultaneously.

The corrective motion can be made available and thus quickly to the applicable shafts, if the correction function essentially contains only the corrections relative to the guide shaft function and is used as such for the register correction. Because of the practically direct use of the correction signal, this signal can be ascertained with relatively little computer capacity, and in particular with little computation effort.

If the correction function is linked with the guide shaft function to form an additional, chronological register sequence-guide shaft function, then this linking can be done centrally and uniformly in the context of a register correction and transmitted to the appropriate shafts as a register sequence-guide shaft function; the individual shafts can then obey such a register sequence-guide shaft function practically directly and immediately, without decentralized derivations—which involve increased computation effort—having to be made at the individual shafts. The register sequence-guide shaft function then contains practically all the data for every shaft in one uniform signal. Since the technical provisions for furnishing and transmitting a guide shaft function must generally be made anyway, this is a way of attaining the object of the invention that is inherent in the method of the invention, and that can readily be integrated into the existing drive and regulating structures. There are then two guide shaft functions—namely, the unchanged guide shaft function and the register sequence-guide shaft function—for which as a rule the computation and transmission capacities already exist.

The type of correction function should be selected depending on the type of deviations (the extent to which the web of material "goes out of register", or in other words the extent of the deviations compared to what is specified by the register marks) expected or recorded (that is, those scanned in the context of the register correction). The invention is already suitable for many applications in which the deviation is practically constant, if the correction function includes a position offset, compared to the instantaneous position of the guide shaft, that is determined by the scanning of the register marks. In that case, the correction function essentially comprises a position offset that is constant or that varies in accordance with the scanning of the register marks. A register sequence-guide shaft function in this case has a deviation from the guide shaft that is correspondingly either constant or varies—preferably comparatively slowly over time.

In addition or as an alternative, it can be provided that the correction function includes a function, determined by the scanning of the register marks and corresponding to gear speed increase with respect to the guide shaft. In the case of a correction function that includes only the corrective motions, this is equivalent to a pure gear speed increase, which can likewise be constant or varies over time in accordance with the scanning. In the case of claim 3, this is equivalent to a register sequence-guide shaft function, which is derived from the (higher-order) guide shaft function by a gear speed increase.

By means of the aforementioned embodiments, a simplification is attained, namely a possible limitation to only two methods of deviations of the correction function or chronological register sequence-guide shaft function, as a result of which however the invention is suitable for practically all applications that arise.

Any remaining deviations between shafts of one group are minimized by the provision that the scanning is effected practically in a central region—in terms of the longitudinal direction of the web of material—of the register-tracking shafts. The deviations that may possibly remain as a rule have a continuous course—viewed in the longitudinal direction of the web of material—or in other words are practically equal to zero at the scanning point or at the sensor site, since the register correction is referred to this sensor. Measured in the longitudinal direction, they are as a rule strictly monotonous, and they change their sign at the sensor site. In that case, the aforementioned scanning point is the site where the scanning practically leads to the least possible maximum amount of individual deviations at the shafts of the group and at the same time to the smallest sum of amounts of the deviations of the individual shafts from the applicable set-point value.

Particularly in insetting applications in rotary printing presses, it is proposed that one group is provided that includes only transport shafts. The correction function or register sequence-guide shaft function is then definitive for all the transport shafts of the group, so that according to the invention, they can be corrected with high synchronicity. This leads to an extremely precise, common correction of the transport shafts relative to the processing shafts.

To achieve increased accuracy of processing in a register correction of the invention, it is proposed that in addition, a predetermined correction, which is simple in terms of the computation effort/capacity and expense, of processing shafts that in terms of the register correction correspond to the group of transport shafts is effected. The above definition of the corresponding shafts then applies accordingly. Because of this provision, an additional degree of freedom that is easy to achieve is introduced into the controlled system. A simple correction in this sense should be adequate for most cases to compensate for any deviations that might still occur. Precisely in the case of register correction, the requirements for coincidence of the processing with the positions predetermined by the register marks are very stringent. The aforementioned embodiment makes it possible in a simple way to improve this coincidence still further. Deviations that are practically identical for many processing shafts can be eliminated; deviations that may differ for different processing shafts can also be eliminated, however. The latter pertains in particular to a possibly remaining deviation that can occur because of the spacing of a processing shaft from the sensor site (in accordance with what has been said above).

A simple, effective correction along these lines can be attained by providing that the longitudinal error per unit of length of the web of material, and for each processing shaft to be corrected, its longitudinal spacing from the scanning point are ascertained, and the correction of the applicable processing shaft is formed essentially by the product of the longitudinal error and the longitudinal spacing. Since as a rule after the processing the web of material is divided into individual products, it is proposed that the web of material is subdivided into individual products of a predetermined product length, and the longitudinal error per product length is ascertained, and the correction of the applicable processing shaft is formed essentially by the product of the longitudinal error per product length and the quotient of the longitudinal spacing divided by the product length. This method is simplified in terms of the requisite computation performance/capacity. Intrinsically, as a rule it also leads to better coincidence (see above), since the deviation is referred to the product length. The product length is the definitive variable for the processing shafts anyway, and thus the calculation and conversion of the corresponding correction can be done simply and precisely.

The aforementioned additional correction can be realized by providing that a plurality of processing shafts to be corrected form one group as defined by claim 1. This reduces the number of correction calculations required—as a rule, by the number of shafts that are combined into one group or into groups, minus the number of such groups. Because of this combination into a group with corresponding corrections, a central structure with all the advantages of the invention is created; this central structure can be subordinate to other groups. Then processing shafts can be divided into a plurality of groups. What is essential is that the deviation within one group remains comparatively small.

The possible capacities of the method are exploited completely if at least one shaft independent of register is provided, which obeys the chronological guide shaft function. Then two or more guide shaft functions are provided, which are integrated into the system and are used by respective associated shafts; that is, the shafts that belong together obey the respective guide shaft function (or register sequence-guide shaft function).

The invention will be described in further detail in terms of exemplary embodiments shown in the drawings.

DESCRIPTION OF THE PREFERRED EMBODIMENTS

Figure 1A:
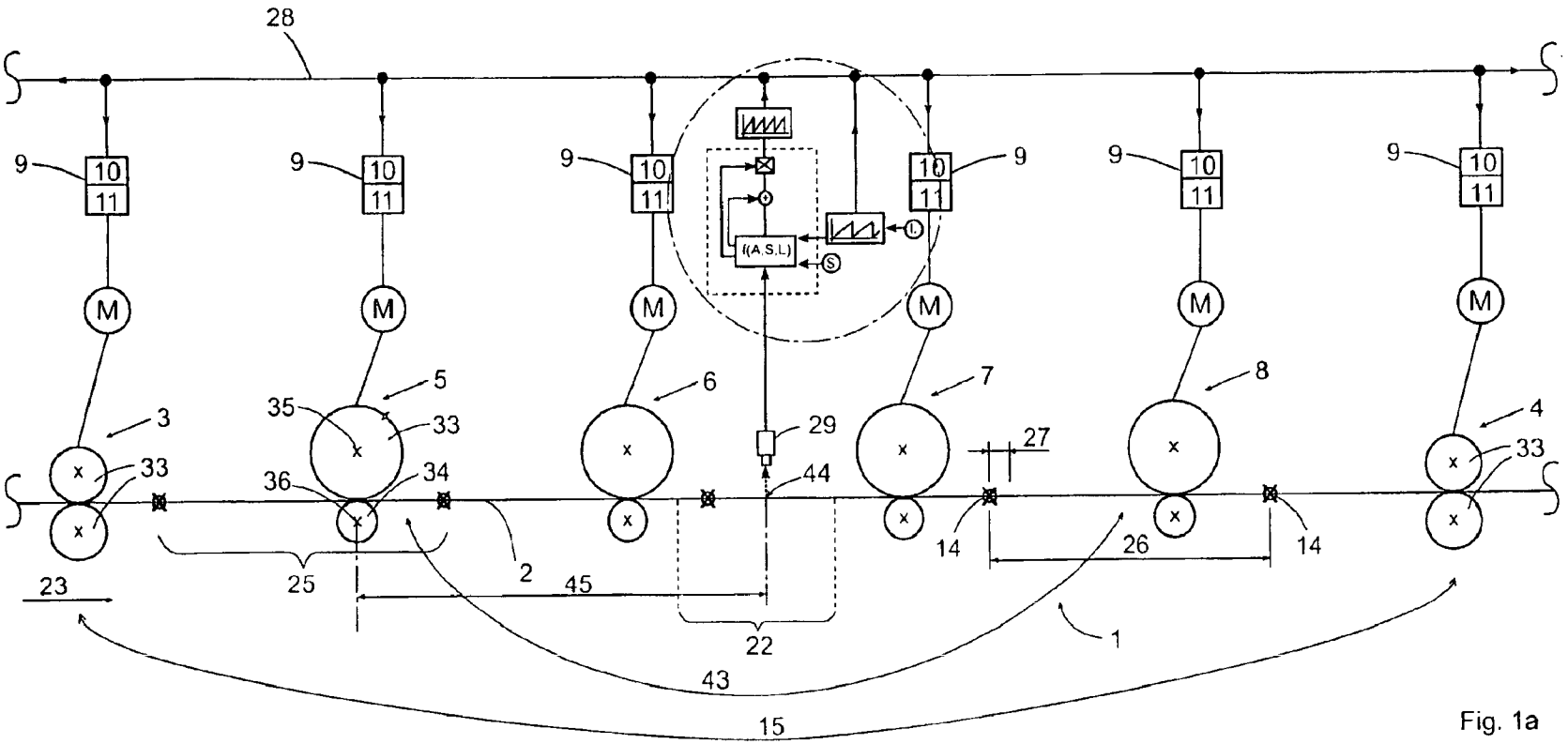
FIG. 1*a*, a schematic illustration of a processing machine, with a register regulator and a drive system, for performing the method of the invention.

Unless otherwise noted below, all the reference numerals always apply to all the drawings.

FIG. 1—in schematically simplified form—shows a processing machine 1 for processing a web of material 2. This is a rotary printing press, comprising a plurality of driven cylinders 33, each with associated contact-pressure cylinders 34.

The processing machine 1 has an input transport station, which is formed essentially by the transport shaft 3 with its two cylinders 33. On the other end (in terms of the longitudinal direction 23), there is an output transport shaft 4, again comprising two cooperating cylinders 33. Between the transport shafts 3, 4, there are four processing stations 5, 6, 7, 8, hereinafter for the sake of simplicity simply called processing shafts 5, 6, 7, 8.

The term "shaft" will be used here for the corresponding station with the associated cylinders 33, their motors M, and the associated drive mechanism 9. The term "shaft" should be distinguished in particular from the physical pivot axis 35, 36 of the respective cylinders 33, 34.

The transport shafts 3, 4 and the processing shafts 5, 6, 7, 8 cooperating with them are each driven by an associated individual drive mechanism 9. This replaces a continuous mechanical shaft (vertical shaft). For that purpose, it is necessary that the individual drive mechanisms 9 be synchronized with one another. To that end, the individual drive mechanisms 9 are supplied with guide shaft signal data (see below) via a data bus 28. For synchronization, the shafts 5, 6, 7, 8 obey a chronological guide shaft function 12, which is fed into the data bus 28 and transmitted over it to the individual drive mechanisms 9. Deviations are compensated for by the register correction by the provision that first register marks 14 (represented here by X's at the corresponding longitudinal positions) are scanned by an (optical) sensor 29. On the basis of the scan, a correction relative to the guide shaft function 12 is then calculated in the register regulator 30, and this correction initially acts only on the register-tracking shafts 3, 4. At first, no register correction of the other processing shafts 5, 6, 7, 8 is contemplated (although that can additionally be effected; see below), and so the register correction is equivalent to a relative correction between the transport shafts 3, 4 and the processing shafts 5, 6, 7, 8.

The guide shaft L (which is unaffected by the register correction) is represented here merely by a circle. It does not matter to the invention whether it is a virtual guide shaft, whose instantaneous position is generated purely electronically, or a so-called real guide shaft, whose instantaneous position is defined by scanning an actually physically present mechanical shaft, or by feedback from a drive mechanism.

According to the invention, a group 15 of the register-obeying guide shafts 3, 4 that correspond to one another in terms of the register correction is formed, as noted above in detail. For this group 15 of register-tracking shafts 3, 4, only one common scanning is performed. This is done at only a single scanning point 44, by means of the sensor 29, which can for instance be a photodiode or a CCD camera, with a downstream electronic evaluator for detecting the register marks.

From the common scanning, a correction function 16 that is likewise common to the group 15 of register-tracking shafts 3, 4 is derived. It can be formed from a set-point/actual comparison in accordance with the scanning of the register marks to form the local deviation, its derivation (that is, the speed), or functions corresponding therewith. In the exemplary embodiment shown, the correction function is formed by comparing the scanner outcome with the set-point value S and/or the guide shaft function 12, which for that purpose is fed—along with the scanning signal from the sensor 29—into an arithmetic unit 31. The set-point value S contains the information that tells which relative position on the web of material the register marks are to be located at the scanning point 44 with respect to the guide shaft function 12 and/or the processing shafts 5, 6, 7, 8.

From the control deviation (corresponding to the correction function 16) formed in the arithmetic unit 31 (see FIG. 1*b*), a register sequence-guide shaft function 17 is derived. This is schematially shown, for the sake of clarity, with a slope that deviates exaggeratedly greatly from the slope of the guide shaft function 12. The guide shaft function 12 is input into the register regulator 30. The linking of the correction function 16 with the guide shaft function 12 is also done in the register regulator 30 of the invention. Since the communication line is a data bus 28, both the (unchanged) guide shaft function 12 and the register sequence-guide shaft function 17 formed from the correction function 16 can be furnished to all the individual drive mechanisms 9; the applicable drive mechanism 9 is triggered or addressed solely in accordance with a variable setting of the predetermined, corresponding guide shaft function 12, or register sequence-guide shaft function 17. The freedom of selection is thus assured; that is, practically every shaft 3, 4, 5, 6, 7, 8 can, in accordance with the (pre-)setting, obey an arbitrary one of the guide shaft functions 12, 17 provided, or the correction function 16, after processing/adaptation—for instance, in the applicable drive regulator 10.

The applicable guide shaft function 12, 17 or the correction function 16 is thereupon processed in the drive regulator 10, and the respective motor M is driven, suitably synchronized/corrected in accordance with the drive regulator, via the power electronics 11.

Figure 1B:
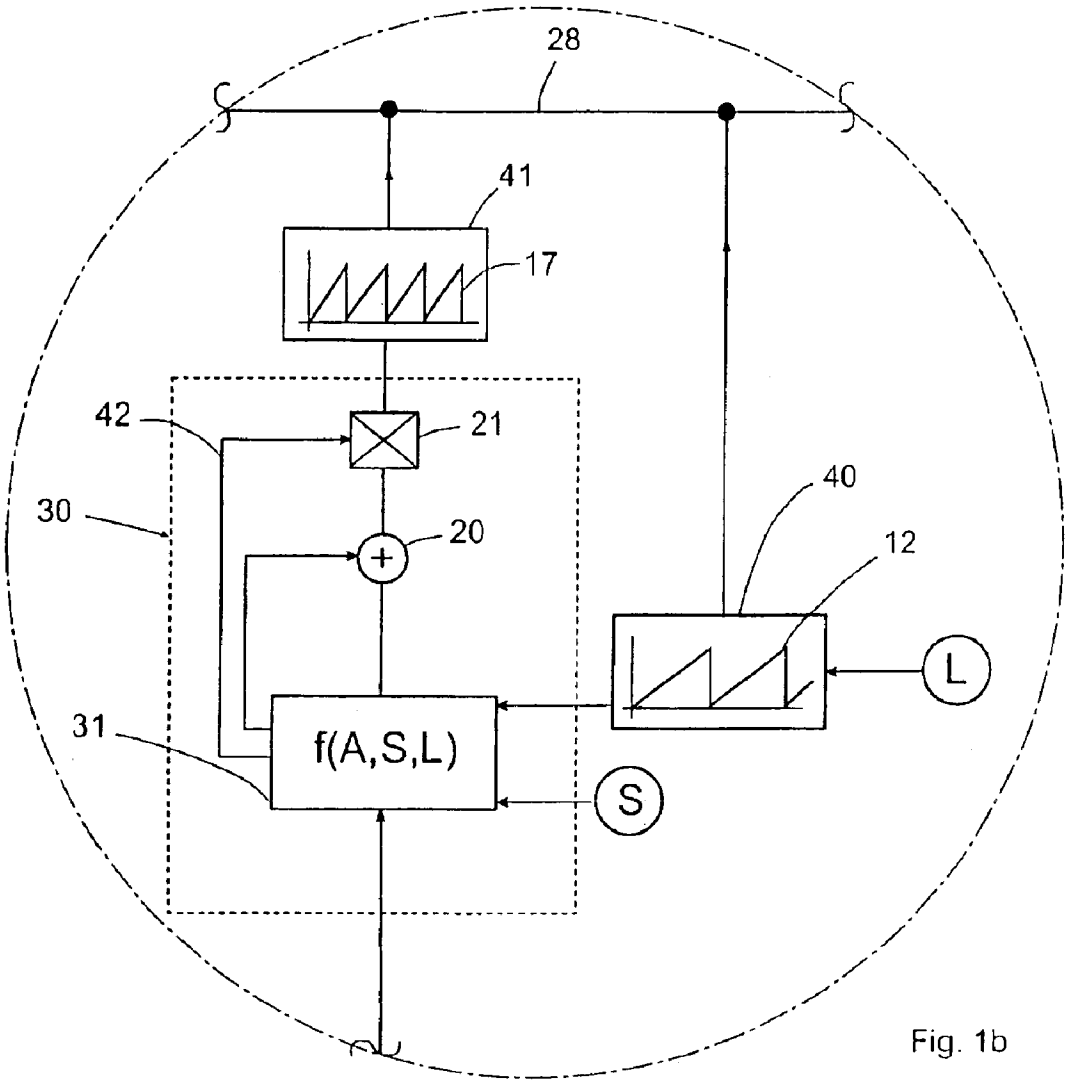
FIG. 1*b*, an enlarged detail of FIG. 1*a* showing details of the register regulator.

How a register correction according to the invention functions is illustrated schematically in an enlarged detail in FIG. 1*b:*

For synchronization of the shafts present, a guide shaft function 12 is generally provided, which can be individually transmitted/addressed to each of the individual drive mechanisms 9 via the data bus 28 and synchronizes the applicable drive mechanism 9 in higher-order fashion. The register regulator 30 is shown in detail on the left side of the enlarged detail. There, from the set-point value S and the scanning signal A, the correction function 16 is formed and, in accordance with the correction with the higher-order guide shaft function 12, is processed into a register sequence-guide shaft function 17. It can be seen from the detail that individually, first on the base of the set-point value S, guide shaft function 12 or guide shaft L and a scanning signal A, a function f(A, S, L) is calculated in the arithmetic unit 31. This could be the correction function 16. In the present case, it is a (preferably instantaneous/updated) predetermination, in accordance with which, via the parameter line 42, the register sequence-guide shaft function 17 is derived from the guide shaft function 12. As shown in the detail, only one offset adder 20 and/or one gear element 21, which is addressed by the arithmetic unit 31 via the parameter lines 42, is provided for deriving the register sequence-guide shaft function 17. This means that in accordance with the scanning, either a pure position offset 19 or a gear derivation or both is used to derive the register sequence-guide shaft function 17. For forming the correction function 16 or register sequence-guide shaft function 17, either the extent of the position offset 19, or the gear speed increase for the gear element 21, or both are calculated, from the result of scanning, the set-point value (which can also be a chronological set-point value function) and the guide shaft function 12, and is updated, preferably in the context of the clock speed involved and the expected time constant for the regulator system. Via the parameter line, the parameters required to form this function are thus carried to the members 20, 21.

If no control deviation or correction is desired, then all the parameters can be dimensioned or predetermined such that the members 20 and/or 21 have no significance, and the register sequence-guide shaft function 17 is essentially the same as the guide shaft function 12. Both guide shaft functions 12, 17 present are sent onward via the respective guide shaft generators 40, 41 (for instance in the form of software in the arithmetic unit), addressed appropriately. The addressing will not be discussed in further detail here; however, it is done selectively for each individual drive mechanism 9 in accordance with its parameters, namely the spacing of the associated shafts 3, 4 from the scanning point 44, etc. This will be discussed in further detail hereinafter.

In addition or alternatively, a correction function 16 can also be provided which essentially contains only the corrections relating to the guide shaft function 12 and which—for the shafts 3, 4 of group 15—acts directly as a correction applied to the global synchronization cycle of the guide shaft function 12—specifically in the respective drive mechanism 9.

In addition to the transport shafts 3, 4, processing shafts 5, 8 can also be combined into a group 43. Its own, for instance additional, register-obeying guide shaft function acts on this group. It is also possible for all the processing shafts 5, 6, 7, 8 to be combined into a group. Then the processing shafts 5, 8 that are farthest away from the scanning point 44 are combined into a group 43, since for such a group any (residual) deviation that exists is especially great, as noted above. As for the register-tracking shafts 3, 4; 5, 8 of the groups 15; 43, the scanning is done practically in a central region 22, in terms of the longitudinal direction 23 of the web of material 2, or in other words practically in the middle between the aforementioned shafts. As a result—as noted above—any remaining (register) deviations from one another among the register-tracking shafts are minimized.

A correction that is simple in terms of computation effort acts on the processing shafts 5, 8 of the group 43. This correction is formed by dividing the web of material into products 25 of a product length 26, which in the present case matches the spacing of the register marks 14 (although this is not necessarily the case). By means of the register correction, the longitudinal error 27 (shown exaggerated here) per product length 26 is ascertained. For each processing shaft 5, 8 to be corrected, its longitudinal spacing 45 from the scanning point 44 is ascertained, and the correction of the processing shafts 5 is formed by the product of the longitudinal error and the quotient of longitudinal spacing 45 divided by product length 26.

Figure 2:
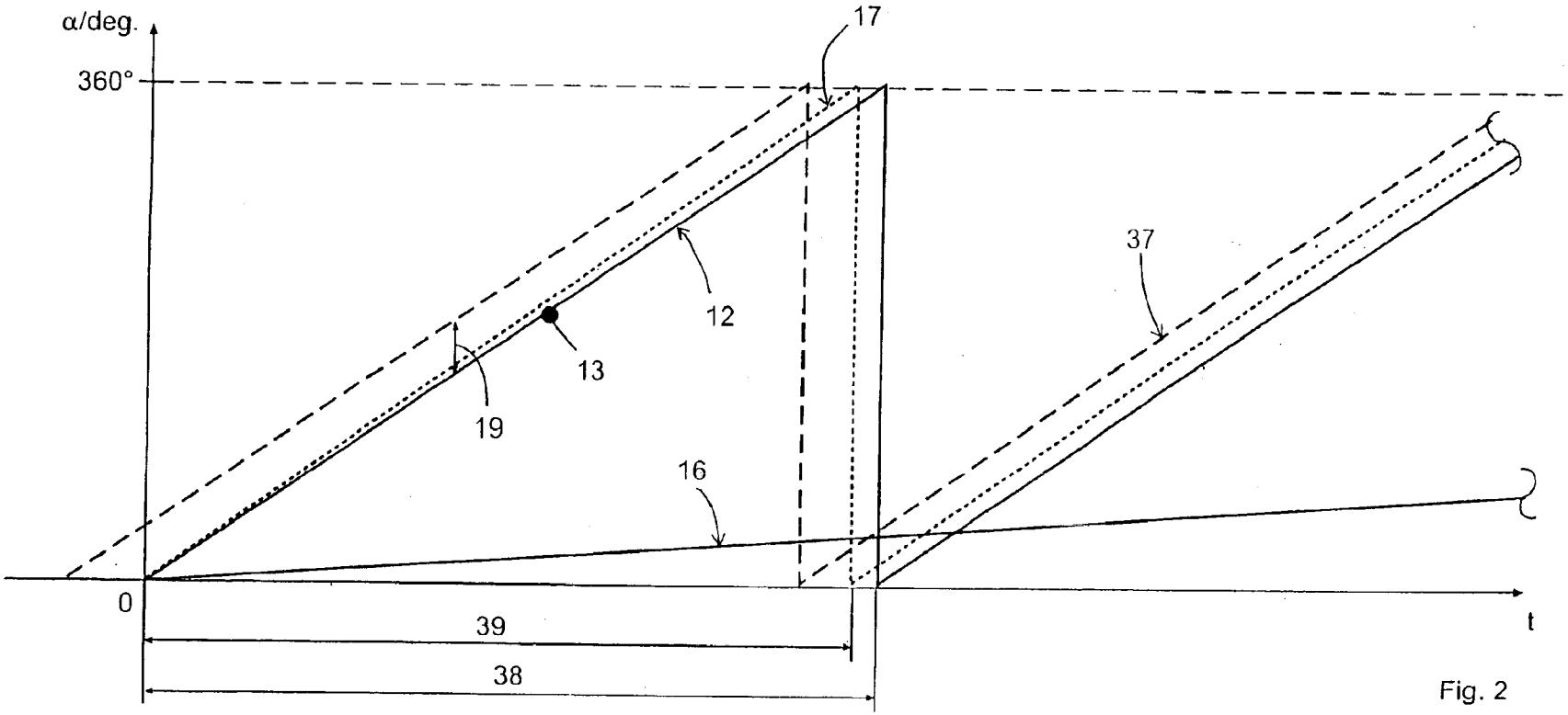
FIG. 2, a graph of a guide shaft function, a register sequence-guide shaft function, and a correction function.

Finally, FIG. 2 shows a graph of various guide shaft functions 12, 17, 37 and a correction function 16. The instantaneous position is plotted in angular degrees over time t. The register sequence-guide shaft function 17 and the register sequence-guide shaft function 37 are examples of corrective guide shaft functions derived from the unchanged guide shaft function 12. The register sequence-guide shaft function 37 comprises only one position offset 19 relative to the guide shaft function 12. The register sequence-guide shaft function 17 has a gear derivation from the guide shaft function 12; as a result, the register sequence-guide shaft function 17 has a different slope from the guide shaft function 12 and thus also a different period 39, compared to the period 38 of the guide shaft function 12. Because of the greater slope of the register sequence-guide shaft function 17, the associated period 39 is shorter.

Also shown in FIG. 2 is a correction function 16. It represents only the corrections relative to the guide shaft function 12 by which the register-tracking shafts 3, 4; 5, 8 are optionally corrected. Instead of the instantaneous position $\alpha$ in angular degrees, an angular speed could for instance be provided as a transducer signal for the corresponding guide shaft functions/corrective functions.

What is claimed is:

1. A method for register correction in machines for processing webs of material, comprising the steps of providing at least one transport shaft and at least one processing shaft cooperating with the at least one transport shaft, driving the shafts synchronously with one another each by an individual drive mechanism; obeying by at least one shaft a chronological guide shaft function which corresponds to an instantaneous position of a guide shaft; correcting a plurality of register-tracking shafts formed by the transport shafts in accordance with a scan of register marks of the web of material relative to the guide shaft function; effecting only one common scanning for one group of the register-tracking shafts which correspond to one another in term of the register correction; and deriving from the only one common scanning a common correction function that all of the register-tracking shafts of the group obey.

2. A method as defined in claim 1; and further comprising including in the correction function substantially only a correction relative to the guide shaft function; and using the correction function which includes essentially only the correction relative to the guide shaft function, for the register correction.

3. A method as defined in claim 1; and further comprising linking the correction function with the guide shaft function to make an additional chronological register sequence-guide shaft function.

4. A method as defined in claim 1; and further including in the correction function a position offset determined by the scanning of the register marks, relative to an instantaneous position of the guide shaft.

5. A method as defined in claim 1; and further including in the correction function a function determined by the scanning of the register marks and corresponding to a gear speed increase with respect to the guide shaft.

6. A method as defined in claim 1; and further comprising effecting the scanning substantially in a central region, referred to a longitudinal direction of the web of material, of the register-tracking shafts.

7. A method as defined in claim 1; and further comprising including in the one group only the transport shafts for insetting applications in rotary printing presses, paper processing machines or sheet-fed printing presses.

8. A method as defined in claim 1; and further comprising effecting additionally a predetermined correction, which is simple in terms of computation effort and expense, of the processing shafts, which in terms of the register correction corresponds to the group of the transport shafts, in accordance with the scanning.

9. A method as defined in claim 1; and further comprising ascertaining a longitudinal error per unit of length of the web of material; and for each of the processing shafts to be corrected, its longitudinal spacing from a scanning point; and forming the correction of an applicable one of the processing shafts substantially by a product of the longitudinal error and the longitudinal spacing.

10. A method as defined in claim 1; and further comprising subdividing the web of material into individual products of a predetermined product length; ascertaining a longitudinal error per product length; and forming the correction of an applicable one of the processing shafts substantially by a product of the longitudinal error per product length and a quotient of the longitudinal spacing divided by the product length.

11. A method as defined in claim 1; and further comprising forming the one group by a plurality of the processing shafts to be corrected.

12. A method as defined in claim 1; and further comprising providing at least one shaft which is independent of the register and obeys the chronological guide shaft function.

* * * * *